US005845961A

United States Patent [19]

LaPointe et al.

[11] Patent Number: 5,845,961

[45] Date of Patent: Dec. 8, 1998

[54] DUAL LEG REST ASSEMBLY HAVING SELECTABLE HEIGHT OTTOMAN

[75] Inventors: Larry P. LaPointe, Temperance; Jonathan R. Saul, LaSalle; Karl J. Komorowski, Petersburg, all of Mich.

[73] Assignee: La-Z-Boy Incorporated, Monroe, Mich.

[21] Appl. No.: 659,798

[22] Filed: Jun. 7, 1996

Related U.S. Application Data

[63] Continuation-in-part of Ser. No. 319,671, Oct. 12, 1994, Pat. No. 5,582,457, which is a continuation-in-part of Ser. No. 100,915, Aug. 9, 1993, Pat. No. 5,388,886.

[51] Int. Cl.[6] ..... A47C 1/02

[52] U.S. Cl. ..... 297/75; 297/69; 297/85; 297/423.36; 297/70

[58] Field of Search ..... 297/75, 76, 85, 297/68, 89, 423.35, 423.34, 69, 70, 423.36

[56] References Cited

U.S. PATENT DOCUMENTS

| | | | |
|---|---|---|---|
| 27,645 | 5/1860 | McGregor . | |
| 76,577 | 4/1868 | Zinn . | |
| 78,304 | 5/1868 | Martin . | |
| 248,752 | 10/1881 | Huston . | |
| 390,363 | 10/1888 | Ecker et al. . | |
| 1,248,931 | 12/1917 | Schuman . | |
| 1,626,069 | 4/1927 | Beech . | |
| 2,576,466 | 11/1951 | Lorenz | 297/69 X |
| 2,630,162 | 3/1953 | Rechler . | |
| 2,664,942 | 1/1954 | Spear . | |
| 2,682,401 | 6/1954 | Curtis | 297/69 X |
| 2,774,412 | 12/1956 | Luckhardt . | |
| 3,103,381 | 9/1963 | Schliephacke . | |
| 3,244,449 | 4/1966 | Re . | |
| 3,494,660 | 2/1970 | Caldemeyer et al. . | |
| 3,537,747 | 11/1970 | Rogers . | |
| 3,550,952 | 12/1970 | Ferguson . | |
| 3,652,125 | 3/1972 | Rogers, Jr. . | |
| 3,790,211 | 2/1974 | Caldwell . | |
| 3,865,432 | 2/1975 | Rogers, Jr. . | |
| 3,874,724 | 4/1975 | Re . | |
| 3,904,240 | 9/1975 | Rogers, Jr. et al. . | |
| 4,357,049 | 11/1982 | Rogers, Jr. et al. . | |
| 4,367,895 | 1/1983 | Pacitti et al. . | |
| 4,410,213 | 10/1983 | Samson . | |
| 4,519,647 | 5/1985 | Rogers, Jr. . | |
| 4,570,996 | 2/1986 | Rogers, Jr. . | |
| 4,669,778 | 6/1987 | Rogers, Jr. . | |
| 4,674,794 | 6/1987 | Pine . | |
| 4,790,599 | 12/1988 | Goldman . | |
| 4,915,444 | 4/1990 | Rogers, Jr. . | |
| 4,989,914 | 2/1991 | Pine . | |
| 5,090,768 | 2/1992 | Re et al. . | |
| 5,156,441 | 10/1992 | Byersmith et al. . | |
| 5,169,208 | 12/1992 | Re et al. | 297/75 X |
| 5,374,101 | 12/1994 | Wiecek . | |
| 5,419,611 | 5/1995 | Cook . | |

FOREIGN PATENT DOCUMENTS

| | | |
|---|---|---|
| 39568 | 11/1931 | France . |
| 3524056 | 1/1987 | Germany . |
| 73511 | 1/1986 | Taiwan . |
| 878022 | 9/1961 | United Kingdom . |
| 2085292 | 5/1985 | United Kingdom . |

*Primary Examiner*—Laurie K. Cranmer
*Attorney, Agent, or Firm*—Harness, Dickey & Pierce, P.L.C.

[57] ABSTRACT

An improved dual leg rest assembly is disclosed which is adapted for use in single and multi-person articles of furniture (i.e., chairs, sectionals, sofas, loveseats, etc.). More particularly, an improved linkage mechanism is provided for causing coordinated articulating movement of a primary leg rest panel and a secondary leg rest panel (i.e., mid-ottoman) which as disclosed, also includes a selectable height ottoman.

20 Claims, 10 Drawing Sheets

DUAL LEG REST ASSEMBLY HAVING SELECTABLE HEIGHT OTTOMAN

CROSS REFERENCE TO RELATED APPLICATION

The present application is a Continuation-In-Part of U.S. Ser. No. 08/319,671, filed Oct. 12, 1994, now U.S. Pat. No. 5,582,457, which is a Continuation-In-Part of U.S. Ser. No. 08/100,915 filed Aug. 9, 1993, now U.S. Pat. No. 5,388,886.

BACKGROUND OF THE INVENTION

The present invention relates generally to articles of furniture of the type having an extensible leg rest assembly and, in particular, to a dual leg rest assembly having a primary leg rest panel and a secondary leg rest panel interconnected by a linkage mechanism for concurrent articulated movement between stowed and extended positions.

Traditionally, reclining-type articles of furniture (i.e., chairs, sofas, loveseats, sectionals, etc.) are equipped with an actuation mechanism for operatively interconnecting a seat assembly to a stationary frame structure for reclining movement between an "upright" position and various "reclined" positions. As an additional comfort feature, the actuation mechanism may also be adapted to move an extensible leg rest assembly between a retracted (i.e., "stowed") position and a protracted (i.e., "extended") position. The actuation mechanism typically includes a combination of various mechanical linkages that can be selectively actuated for causing either coordinated or independent reclining movement of the seat assembly relative to extensible movement of the leg rest assembly.

As is known, most conventional leg rest assemblies include an upholstered leg rest panel and a pair of scissor-type linkages interconnecting the leg rest panel to the actuation mechanism for movement between the stowed and extended positions. In the extended position, a gap is created between a front edge of the seat and a rear edge of the leg rest panel such that only the seat occupant's feet and lower legs are supported on the leg rest panel. In an effort to provide additional leg support, it has been proposed to incorporate a second leg rest panel (i.e., a mid-ottoman) into the leg rest assembly between the seat and the primary leg rest panel to provide a substantially uninterrupted leg support surface. In essence, such a "dual" leg rest assembly is operable for converting the reclining chair into a chaise lounge chair. Various examples of reclining chairs equipped with a dual leg rest assembly are disclosed in U.S. Pat. No. 2,774,412 (Luckhardt); U.S. Pat. No. 2,871,917 (Schliephacke); U.S. Pat. No. 2,914,114 (Fletcher); U.S. Pat. No. 3,537,747 (Rodgers); U.S. Pat. No. 4,674,794 (Pine); and U.S. Pat. No. 5,090,768 (Re). However, most conventional dual leg rest assemblies have a linkage mechanism that is relatively complex, bulky, and expensive to manufacture. Commonly, this complexity is due to the need to provide and maintain adequate clearance between the two leg panels during the concurrent articulated movement therebetween. In addition, some conventional dual leg rest assemblies require the secondary leg rest panel to be thinner than the primary leg rest panel to again maintain adequate clearance therebetween during articulated movement.

Additionally, these conventional leg rest assemblies have fixed height leg rest panels which do not provide for a variety of leg rest heights. Varying the height of the leg rest panels to accommodate different seating platform heights requires a new and different leg rest mechanism which is limited for use with one style of chair. This problem becomes compounded when such a conventional dual leg rest assembly designed for residential furniture applications having a lower seating platform is used in conjunction with commercial style furniture, which is typically provided with a higher seating platform. An exemplary type of commercial furniture is health care furniture which typically employs a higher seating platform as a standard feature for comfort, and to assist the occupant in entering and exiting the chair. The increased height of the seating platform coupled with the lowered and fixed height of the associated leg rest panels limits the comfort features associated with such a reclining style chair. Conventional mechanisms do not comprise a single design dual leg rest assembly which can be used with both residential and commercial style furniture by providing an ottoman link configured to easily change the height of the associated leg rest panels.

Thus, while some conventional dual leg rest assemblies operate satisfactorily for their intended purpose, furniture manufacturers are continually striving to develop an improved linkage mechanism for reduced complexity, increased structural soundness and smoother operation as well as for enhanced occupant comfort and convenience. Furthermore, there is a continuing desire to develop an improved linkage mechanism which reduces fabrication and assembly costs while promoting enhanced product quality and a leg rest mechanism that has selectable features allowing for universal application across multiple styles of reclining chairs.

SUMMARY OF THE INVENTION

Accordingly, the present invention is generally directed to providing an improved "dual" leg rest assembly having selectable height leg rest features that provide for universal application of the mechanism in various styles of furniture. Therefore, a primary object of the present invention is to provide an improved linkage mechanism for a dual leg rest assembly which reduces its overall complexity and cost and employs universal components while providing smooth operation and enhanced comfort to the seat occupant.

It is another object of the present invention to provide a linkage mechanism for a dual leg rest assembly that can be installed into various styles of furniture without requiring significant modification of the article and, in essence, in substitution for a traditional leg rest assembly.

In a preferred embodiment of the present invention, a reclining chair is equipped with a dual leg rest assembly having a primary leg rest panel and a secondary leg rest panel interconnected by a unique linkage mechanism for concurrent articulated movement between "stowed" and "extended" positions.

In an alternative preferred embodiment of the present invention, a reclining chair is equipped with a dual leg rest assembly having a primary leg rest panel, and a secondary leg rest panel secured to a selectable height ottoman link. These leg rest panels are also interconnected by a unique linkage mechanism for concurrent articulated movement between "stowed" and "extended" positions. The height selection feature of the present invention provides a single design dual leg rest assembly that can be used in residential style furniture having a lower seating platform by placing the ottoman link in its lower position during final assembly of the chair. The same dual leg rest assembly can also be used in conjunction with commercial style furniture having a higher seating platform by placing the ottoman link in its higher position during final assembly of the chair.

The alternative preferred embodiment also includes a reinforcing link secured to the each support link of the dual leg rest assembly which provides additional strength to the support links. Additionally, a dual leg rest assembly is provided with linkage mechanisms which when fully extended form a profile type configuration.

Various other objects, features and advantages of the present invention will become apparent to one skilled in the art from studying the following written description, taken in conjunction with the accompanying drawings and appended claims.

DETAILED DESCRIPTION OF THE INVENTION

In accordance with the teachings of the present invention, an improved "dual" leg rest assembly is disclosed which is adapted for use in single and multi-person articles of furniture (i.e., chairs, sectionals, sofas, loveseats, etc.). More particularly, an improved linkage mechanism is disclosed that is operable for causing coordinated articulating movement of a primary leg rest panel and a secondary leg rest panel (i.e., mid-ottoman). Moreover, while the particular embodiment disclosed teaches of manually actuating the improved linkage mechanism via a well-known handle-type actuation mechanism, it will be understood, however, that the principles of the present invention apply equally to other actuation systems known to those skilled in the art. For example, the linkage mechanism of the present invention can alternatively be actuated in response to reclining movement of the seat assembly or via a motor driven actuation system. In addition, it will be appreciated that the novel dual leg rest assembly of the present invention is universally applicable for incorporation and use with virtually any reclining-type article of furniture for converting it into a chaise lounge-type seating arrangement. Finally, since the particular form of the article of furniture does not per se comprise part of the invention, only those portions or components thereof necessary for a clear understanding of the invention will be described with any specificity.

Figure 1:
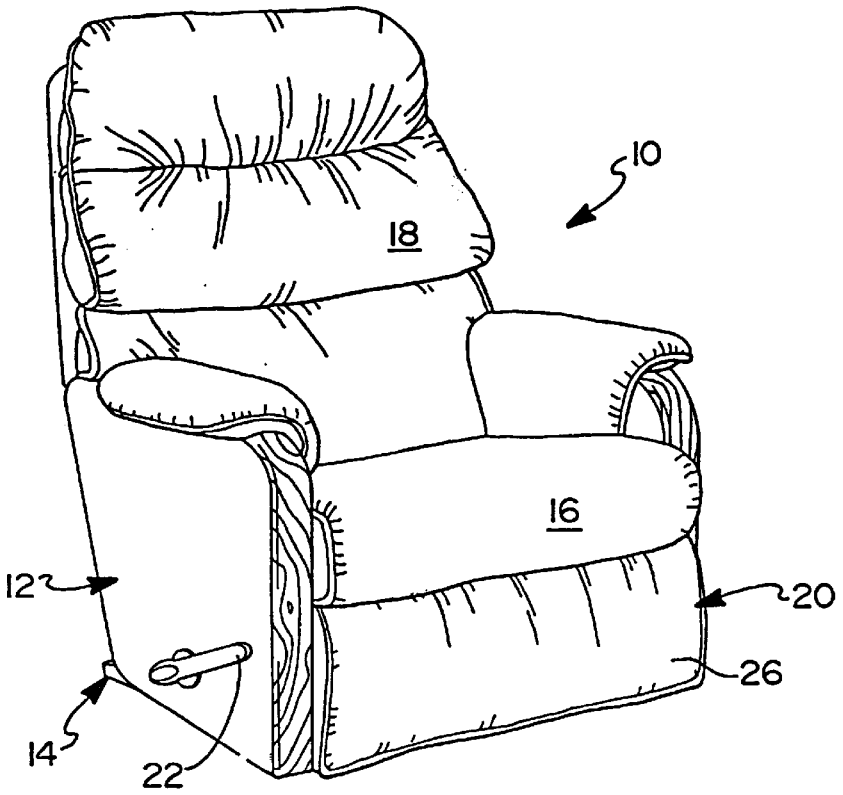
FIG. 1 is a perspective view of an exemplary reclining chair having the dual leg rest assembly of the present invention shown in a fully retracted or "stowed" position.
Figure 2:
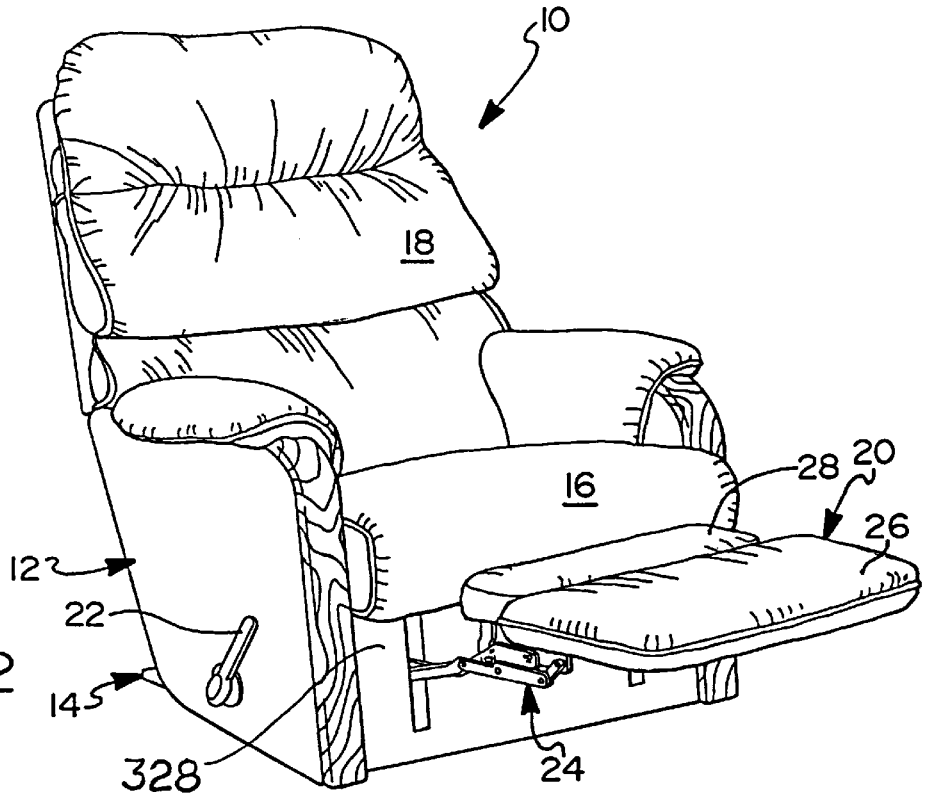
FIG. 2 is another perspective view of the reclining chair showing the dual leg rest assembly protracted to a fully "extended" position.

With reference to the drawings, and particularly FIGS. 1 and 2, an exemplary rocker/recliner chair 10 is shown to include an upholstered chair frame 12 that is supported for rocking movement from a stationary platform-type base assembly 14. A cushioned seat member 16 and a cushioned seatback member 18 are supported from chair frame 12 and define a seat assembly. The seat assembly is supported on chair frame 12 via any suitable reclining mechanism for permitting reclining movement thereof between an "upright" position and a fully "reclined" position. Chair 10 is also shown to include an extensible leg rest assembly 20 that can be moved between a "stowed" position (FIG. 1) and a fully "extended" position (FIG. 2) in response to manual actuation of a suitable actuation mechanism, such as by rotation of a handle 22. As will be detailed, angular rotation of handle 22 is adapted to cause an actuation mechanism, such as a drive rod 23, to urge a pair of linkage mechanisms 24 to move synchronously between retracted and protracted positions for causing the concurrent articulated movement of a primary leg rest panel 26 and a secondary leg rest panel 28 between their stowed and extended positions, respectively. In the stowed position, secondary leg rest panel 28 is maintained in a position behind and generally parallel to primary leg rest panel 26 so as to be concealed from view. However, when handle 22 is rotated to synchronously drive linkage mechanisms 24 toward their protracted state, secondary leg rest panel 28 folds out or "pops up" to establish a generally continuous and uninterrupted leg support surface between a front edge of seat cushion 16 and a rear edge of primary leg rest panel 26.

Figure 3:
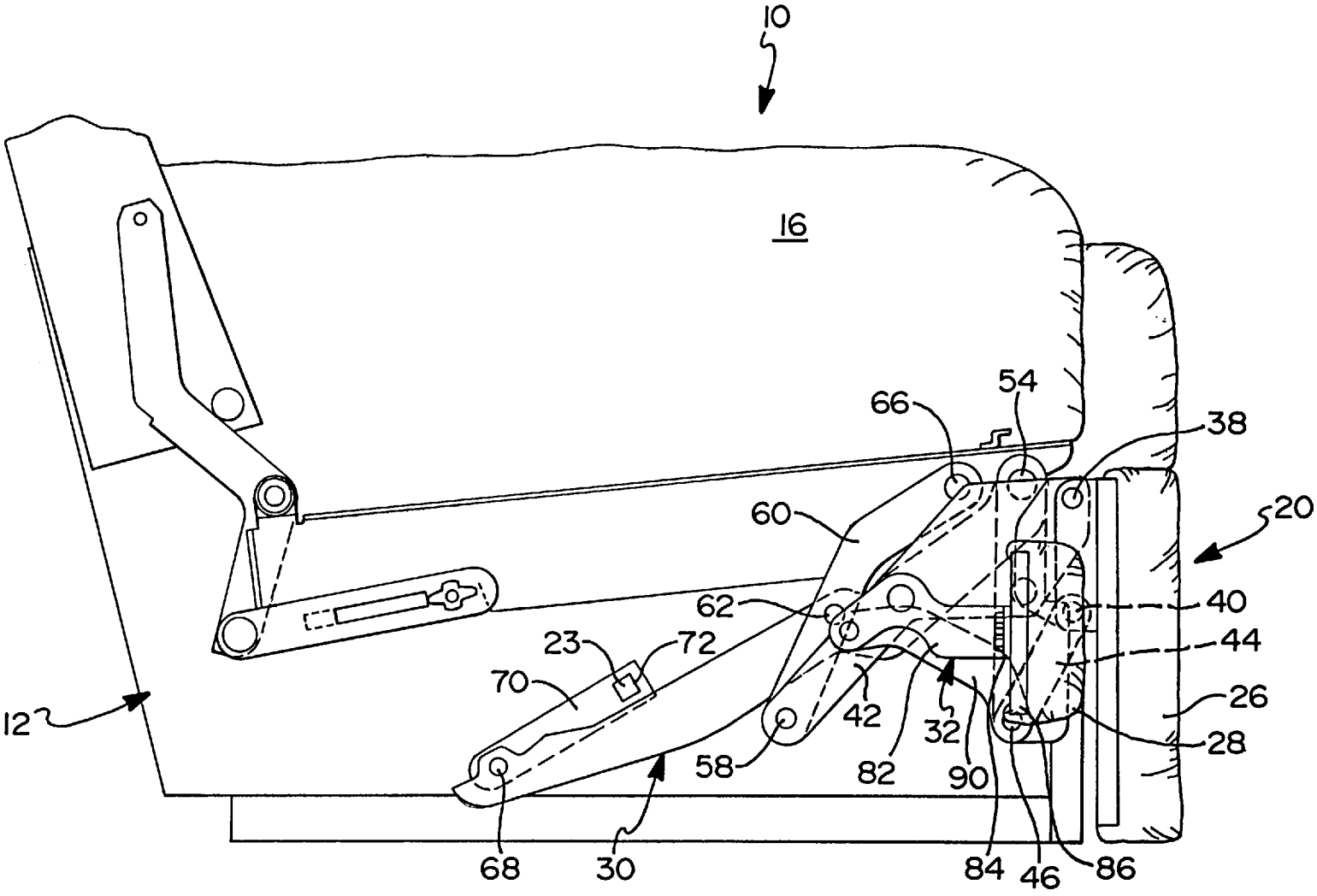
FIG. 3 is an enlarged, fragmentary elevational view of the reclining chair showing the linkage mechanism for the dual leg rest assembly in a fully retracted condition.
Figure 4:
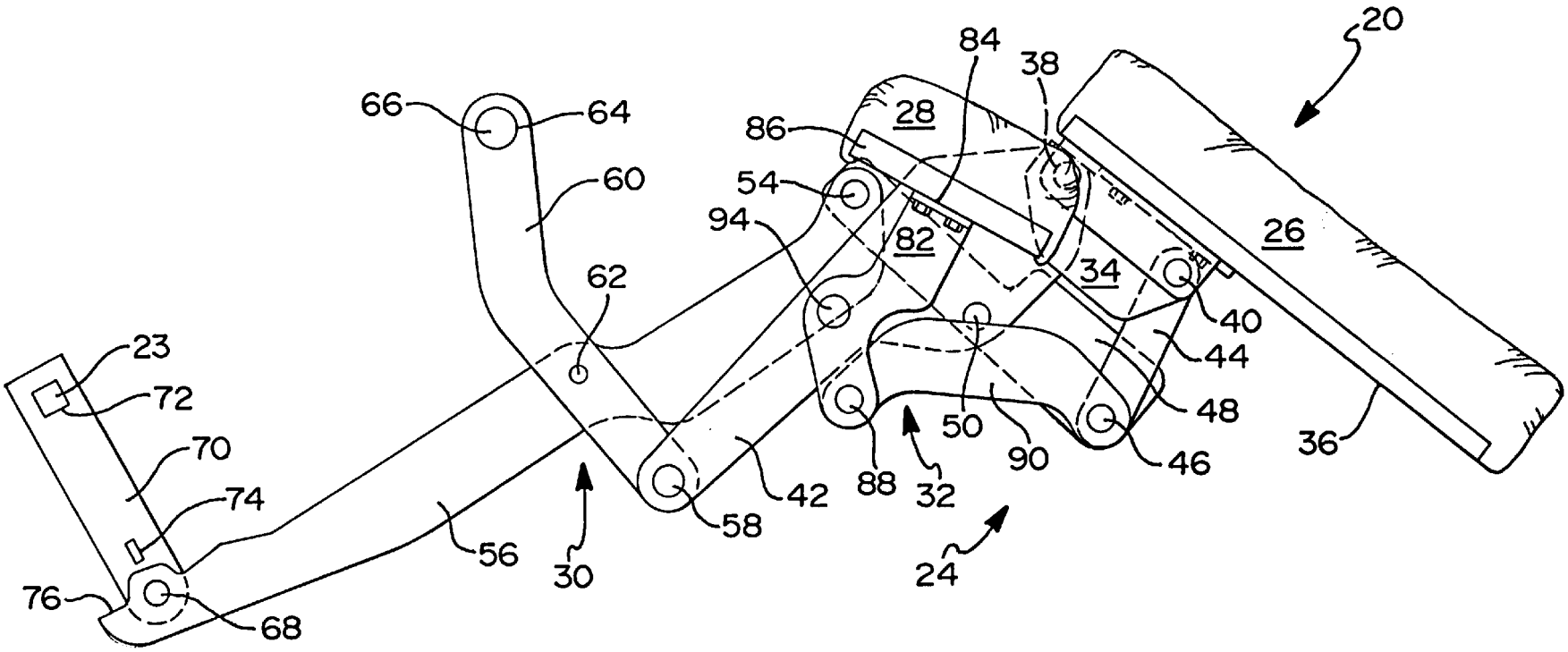
FIG. 4 is a view of the linkage mechanism for the dual leg rest assembly in a partially extended condition.
Figure 5:
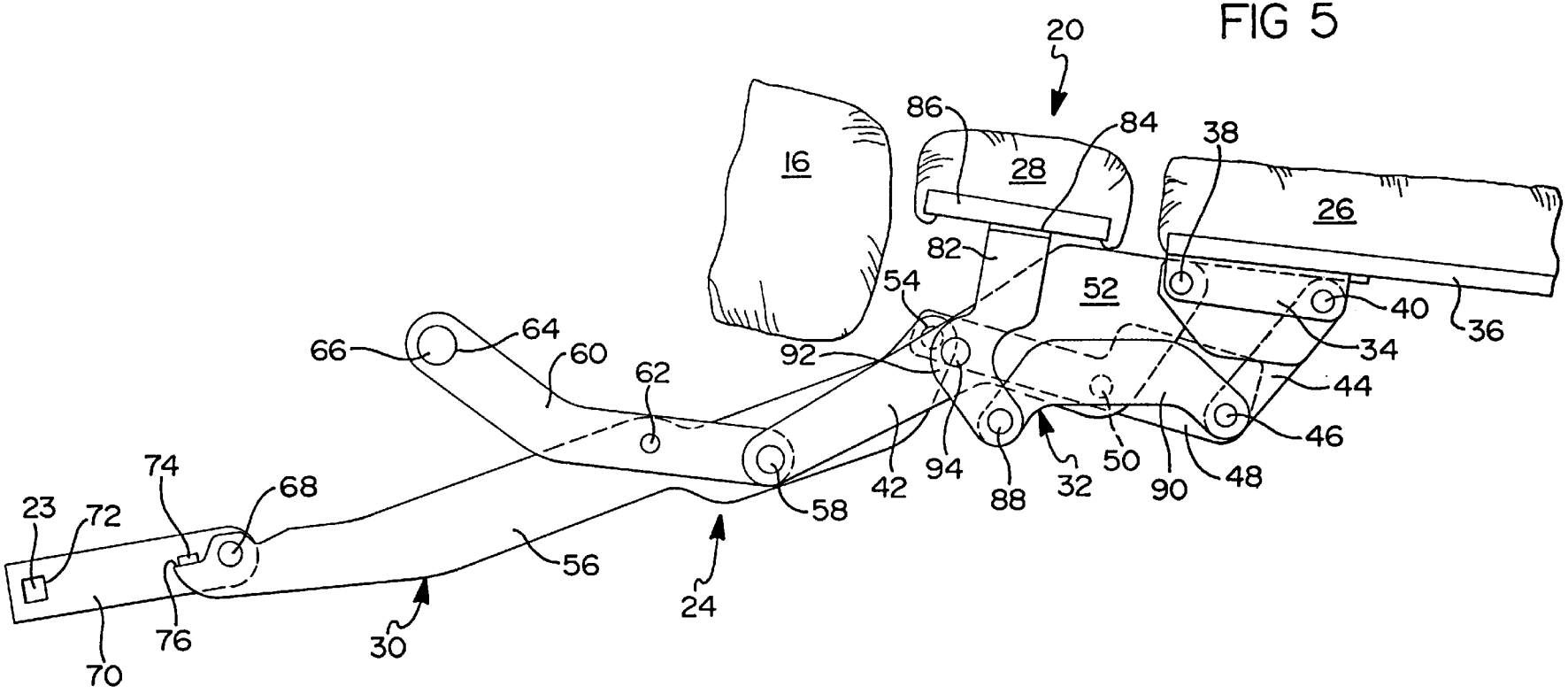
FIG. 5 illustrates the linkage mechanism for the dual leg rest assembly in the fully extended condition.

In general, the present invention is primarily directed to the novel construction of linkage mechanisms 24. Although a more detailed description of the mechanical structure and operation of dual leg rest assembly 20 will be provided in the following paragraphs, a brief overview of its operation is warranted. Initially when an occupant of chair 10 pulls upwardly on handle 22 with a counter-clockwise rotation, the resulting rotation of drive rod 23 causes linkage mechanisms 24 to be urged forwardly toward a protracted position (FIGS. 2, 4 and 5). To stow leg rest assembly 20, the seat occupant simply pushes downwardly on handle 22 in a clockwise direction which, in turn, causes linkage mechanisms 24 to move toward a fully retracted position (FIGS. 1 and 3). Alternatively, the seat occupant may, for certain recliners, simply apply a downward force with his feet on primary leg rest panel 26 which, in turn, causes linkage mechanisms 24 to retract. Typically, a spring-biased toggle mechanism (not shown) is provided which acts on the actuation mechanism and/or linkage mechanisms 24 for assisting in fully extending and retracting linkage mechanisms 24 and, in turn, leg rest panels 26 and 28.

With particular reference now to FIGS. 3 through 5, the functional and structural aspects of the components associated with dual leg rest assembly 20 will be described with greater detail. As will be appreciated, while only one linkage mechanism 24 is shown, a substantially identical linkage mechanism is provided on the opposite lateral side of chair 10. Accordingly, each linkage mechanism 24 includes a primary linkage assembly 30 for causing extensible movement of primary leg rest panel 26 and a secondary or mid-ottoman linkage assembly 32 for causing concurrent and coordinated movement of secondary leg rest panel 28. As will be detailed, secondary linkage assembly 32 is operatively supported from primary linkage assembly 30 for articulated movement in response to movement of primary linkage assembly 30.

Primary linkage assembly 30 includes an angled bracket 34 secured via suitable fasteners to one lateral edge of a rigid frame board 36 associated with primary leg rest panel 26. As such, frame board 36 is pivotably connected at a rear pivot 38 and a front pivot 40 to one end of an elongated rear board link 42 and a shorter front board link 44, respectively, of linkage mechanism 24. The opposite end of front board link 44 is pivoted at 46 to one end of a connector link 48 which, in turn, is centrally pivoted at 50 to an enlarged segment 52 of rear board link 42. In addition, the opposite end of connector link 48 is pivoted at 54 to the top end of a long support link 56. Similarly, the opposite end of rear board link 42 is pivoted at 58 to one end of a curved swing link 60 which is pivoted at a central pivot 62 to an intermediate segment of long support link 56. The other end of curved swing link 60 is journally supported from a front support shaft 64 for rotation about a pivot 66. In the embodiment shown, support shaft 64 is non-rotatably fixed to opposite side frame portions of chair frame 12 to act as a rigid upper cross rail member. While not shown, suitable clips are also provided for maintaining the desired lateral spacing between the pair of linkage mechanisms 24 on support shaft 64.

Another connection point is pivot 68 interconnecting the curved bottom end of support link 56 and a first end of a drive link 70, the other end of which has a square hole 72 through which square drive rod 23 extends. As such, angular movement of drive rod 23 causes concurrent angular movement of drive link 70 and visa versa. Thus, selective rotation of drive rod 23 via handle 22 causes drive link 70 to rotate which acts through pivot 68 to move long support link 56. Such movement of support link 56 causes curved link 60 to swing about "fixed" pivot 66 by virtue of pivot connection 62 that curved link 60 has with long support link 56. The action of curved link 60 swinging about fixed pivot 66 acts to move rear board link 42 outwardly and upwardly. In addition, pivot 54 at the top end of long support link 56 causes connector link 48 to swing about pivot 50 such that front board link 44 is also moved outwardly and upwardly. This extensible action of primary linkage assembly 30 takes place simultaneously with both the left hand and right hand linkage mechanisms 24 when there is sufficient angular rotation of drive rod 23. In this manner, frame board 36 and primary leg panel 26 are moveable between their "stowed" vertical position and "extended" protracted position.

Drive link 70 is preferably U-shaped having parallel short and long legs joined by a base portion which overlies drive rod 23. Both legs have square aligned holes through which square drive rod 23 extends. When dual leg rest assembly 20 is protracted to its fully "extended" position, a cold deformed stop tap 74 on the long leg of drive link 70 contacts a stop shoulder 76 formed on the lower end of long support link 56 when the long leg of drive link 70 and support link 56 are almost in relatively collinear alignment. Due to engagement of stop tab 74 and stop shoulder 76, further extension of primary linkage assembly 30 is inhibited such that primary leg rest panel 26 is held in an elevated and generally horizontal position.

In addition to the above structure, each linkage mechanism 24 includes a secondary linkage assembly 32 which is supported from and interactively associated with primary linkage assembly 30 to cause articulated movement of secondary leg rest panel 28 in response to articulated movement of primary leg rest panel 26. Secondary linkage assembly 32 includes a board link 82 having an angled segment 84 adapted to be secured to one lateral edge of a rigid frame board 86 associated with secondary leg rest panel 28. The distal end of board link 82 is pivotably connected at a pivot 88 to one end of a curved connector link 90, the opposite end of which is connected at pivot 46 with front board link 44 and connector link 48. Moreover, an intermediate offset section 92 of board link 82 is pivotably connected at a pivot 94 to a central segment of rear board link 42.

As is most clearly seen from sequential review of FIGS. 3 through 5, rotation of drive rod 23 causes primary linkage assembly 30 to drive primary leg rest panel 26 between a generally vertically oriented alignment (stowed) and a generally horizontal alignment (extended). As is also shown, the front edge of seat member 16 is, in this particular embodiment, caused to move forwardly in concert with articulation of linkage mechanisms 24 to provide a predetermined relationship therebetween. Thus, in this instance, the recliner mechanism is adapted to work in coordination with the extensible movement of leg rest assembly 20. Moreover, secondary linkage assembly 32 is adapted to cause secondary leg rest panel 28 to move from a position behind and substantially parallel to primary leg rest panel 26 in the stowed position to a generally coplanar alignment relative thereto in the extended position. Moreover, secondary leg rest panel 28 pivots in an arcuate path about pivot 94 and is driven through this arcuate path due to the interconnection between board link 82 and front board link 44 via connector link 90. Due to the novel yet simplified linkage arrangement of the present invention, a desired clearance is maintained between the leg rest panels such that the thickness of upholstered leg rest panels 26 and 28 can be identical to promote more attractive styling and enhanced leg support and comfort.

An additional feature of the present invention is that several of the above-disclosed links have been configured to act as shields for inhibiting access to any pinch points during the extensible movement of linkage mechanism 24 between the links and/or between the leg rest panels. This feature is most clearly seen in FIGS. 3 through 5 wherein portions of angled bracket 34, enlarged segment 52 of rear board link 42 and connection link 48 are shown to overlap.

With particular reference to FIGS. 6 through 9, an alternative embodiment is disclosed for the dual leg rest assembly of the present invention. More particularly, a modified linkage mechanism is disclosed that is operable for causing coordinated articulating movement of a primary leg rest panel and a secondary leg rest panel. As with the embodiment disclosed with respect to FIGS. 1 though 5, the modified linkage mechanism can be manually actuated via well-known handle-type actuation mechanisms or, alternatively, can be actuated in response to reclining movement of the seat assembly or via a motor driven actuation system. Since the particular form of the article of furniture does not per se comprise part of this invention, only those portions or components thereof necessary for a clear understanding of the modified linkage mechanism will be described with any specificity. As such, those components shown in FIGS. 6 through 9 that are identical or substantially similar in structure and/or function to those previously described with respect to FIGS. 3 through 5, will hereinafter be identified with primed reference numerals.

With continued reference to FIGS. 6 through 9, the functional and structural aspects of the components associated with dual leg rest assembly 100 will be described with greater specificity. In general, dual leg rest assembly 100 can be substituted for dual leg rest assembly 20 within rocker/recliner chair 10'. In operation, dual leg rest assembly 100 can be moved between a "stowed" position and a fully "extended" position in response to manual actuation of a suitable actuation mechanism, such as by rotation of a handle 22'. As previously described, angular rotation of handle 22' is adapted to cause an actuation mechanism, such as drive rod 23', to urge a pair of linkage mechanisms 102 to move synchronously between retracted and protracted positions for causing the concurrent articulated movement of a primary leg rest panel 26' and a secondary leg rest panel 28' between a stowed and extended positions, respectively. In the stowed position, secondary leg rest panel 28' is maintained in a position behind and generally parallel to primary leg rest panel 26' so as to be concealed from view. However, when handle 22' is rotated to synchronously drive linkage mechanisms 102 toward their protracted state, secondary leg rest panel 28' is pivoted along an arcuate path to establish a generally continuous and uninterrupted leg support surface between a front edge of seat cushion 16' and a rear edge of primary leg rest panel 26'. As will be appreciated, while only one linkage mechanism 102 is shown, a substantially identical linkage mechanism is provided on the opposite lateral side of chair 10'. Accordingly, each linkage mechanism 102 includes a primary linkage assembly 30' for causing extensible movement of primary leg rest panel 26' and an ottoman link 104 for causing concurrent and coordinated movement of second leg rest panel 28'. As will be detailed, ottoman link 104 is operatively supported from primary linkage assembly 30' for articulative movement in response to movement thereof.

While the drawings reflect minor structural changes to the individual links of primary linkage assembly 30', it will be appreciated by those skilled in the art that the components and the pivotable scissor-type extensible (i.e., pantographic) action generated thereby is substantially identical to that previously disclosed for primary linkage 30 of linkage mechanism 24. More particularly, primary linkage assembly 30' includes an angled bracket 34' secured via suitable fasteners to one lateral edge of a rigid frame board 36' associated with primary leg rest panel 26'. As such, frame board 36' is pivotably connected at a rear pivot 38' to one end of an elongated rear board link 42'. In addition, frame board 36' is pivotably connected at a front pivot 40' to one end of a shorter front board link 44'. The opposite end of front board link 44' is pivotably connected at pivot 46' to one end of a connector link 48'. The opposite end of connector link 48' is pivotably connected at pivot 54' to the top end of a long support link 56'. Moreover, connector link 48' is pivotably connected at pivot 50' to an intermediate segment of rear board link 42'. Similarly, the opposite end of rear board link 42' is pivotably connected at pivot 58' to one end of a curved swing link 60' which, in turn, is pivotably connected at a central pivot 62' to an intermediate segment of long support link 56'. The opposite end of curved swing link 60'is journally supported from a front support shaft 64' for rotation about a pivot 66'. In the embodiment shown, support shaft 64' is non-rotatably fixed to opposite side frame portions of chair frame 12' to act as a rigid upper cross-rail member.

Figure 9:
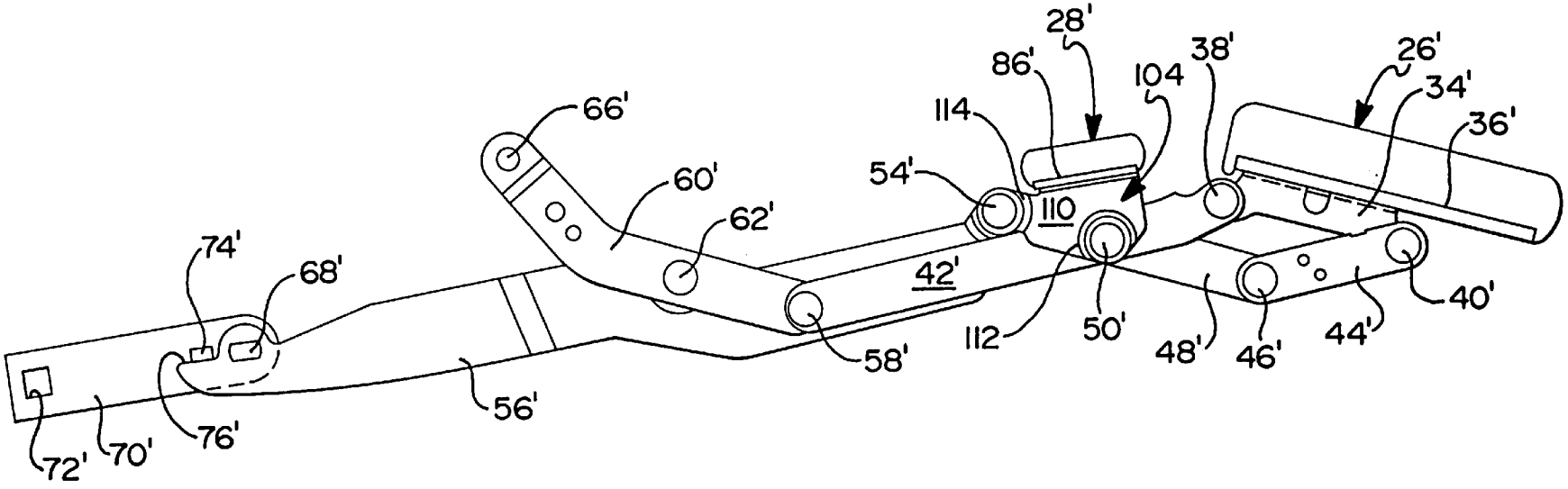
FIG. 9 illustrates the linkage mechanism shown in FIGS. 6 through 8 in a fully extended condition.

A curved bottom end of support link 56' is pivotably connected at pivot 68' to one end of a drive link 70', the other end of which has a square hole 72' through which square drive rod 23' extends. As such, angular movement of drive rod 23' causes concurrent angular movement of drive link 70' and visa versa. In a manner similar to that previously described, selective rotation of drive rod 23' via handle 22' causes drive link 70' to rotate which, in turn, acts through pivot 68' to move long support link 56'. Such action causes curved link 60' to swing about fixed pivot 66' so as to move rear board link 42' outwardly and upwardly. Concurrently, pivot 54' at the top end of long support link 56' causes connector link 48' to swing about central pivot 50' such that front board link 44' is also moved outwardly and upwardly. As best illustrated in FIG. 9, once primary linkage assembly 30' is in the fully "extended" or protracted position, drive rod 23', pivot 68' and pivot 62', and hence drive link 70' and long support link 56', are approximately in-line with respect to one and another. Due to the overall configuration of primary linkage assembly 30', the alignment of various links, including drive link 70' and long support link 56', creates a self-locking condition. Accordingly, primary linkage assembly 30' can readily support the varying weight of different occupants' legs placed on frame board 36' without adversely affecting the operation of dual leg rest assembly 100. Furthermore, the alignment of drive link 70' and long support link 56', in conjunction with stop tab 74', prevents undesired retraction when dual leg rest assembly 100 is in the fully "extended" or protracted position.

As will be appreciated, such extensible action of primary linkage assembly 30' takes place simultaneously with both the left and right hand linkage mechanisms 102 when there is sufficient angular rotation of drive rod 23'. As such, frame board 36' and primary leg panel 26' are movable between their "stowed" vertical position and "extended" protracted position.

In addition to the above structure, each linkage mechanism 102 includes an ottoman link 104 which is supported from and interactively associated with primary linkage assembly 30' to cause articulated movement of secondary leg rest panel 28' in response to articulated movement of primary leg rest panel 26'. In particular, ottoman link 104 has an angled bracket segment 106 that is provided with bores 108 sized for receipt of suitable threaded fasteners for securing thereto a lateral edge of a rigid frame board 86' associated with secondary leg rest panel 28'. As best seen from FIG. 7, bracket segment 106 is inwardly directed such that the length of frame board 86' can be less than that of frame board 36'. This arrangement is preferable when primary leg rest panel 26' is equipped with the extensible leg rest feature disclosed in commonly owned U.S. Pat. No. 5,088,789 entitled "Retro-Fittable Extendable Legrest Apparatus". Ottoman link 104 also includes an enlarged, generally rectangular link segment 110 having an embossed portion 112 about which ottoman link 104 is pivotably connected via pivot 50' to connector link 48' and rear board link 42' of primary linkage assembly 30'. In addition, ottoman link 104 includes an outwardly extending offset flange segment 114 which is pivotably connected about pivot 54' to the upper end of support link 56' and connector link 48'.

Figure 6:
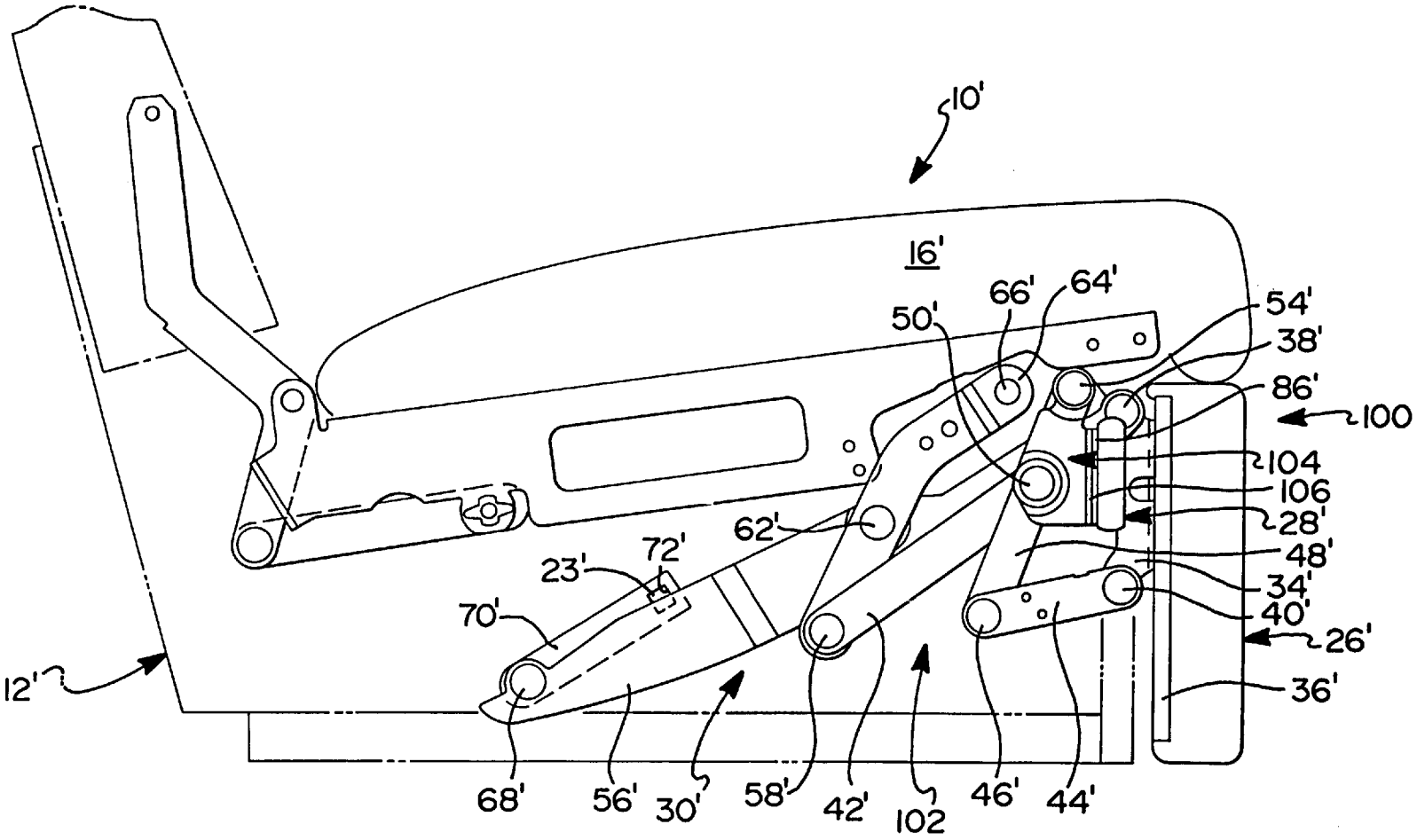
FIG. 6 is a fragmentary elevational view of a reclining chair, generally similar to the reclining chair shown in FIG. 3, illustrating an alternative embodiment of the linkage mechanism for the dual leg rest assembly of the present invention in a fully retracted condition.
Figures 7, 8:
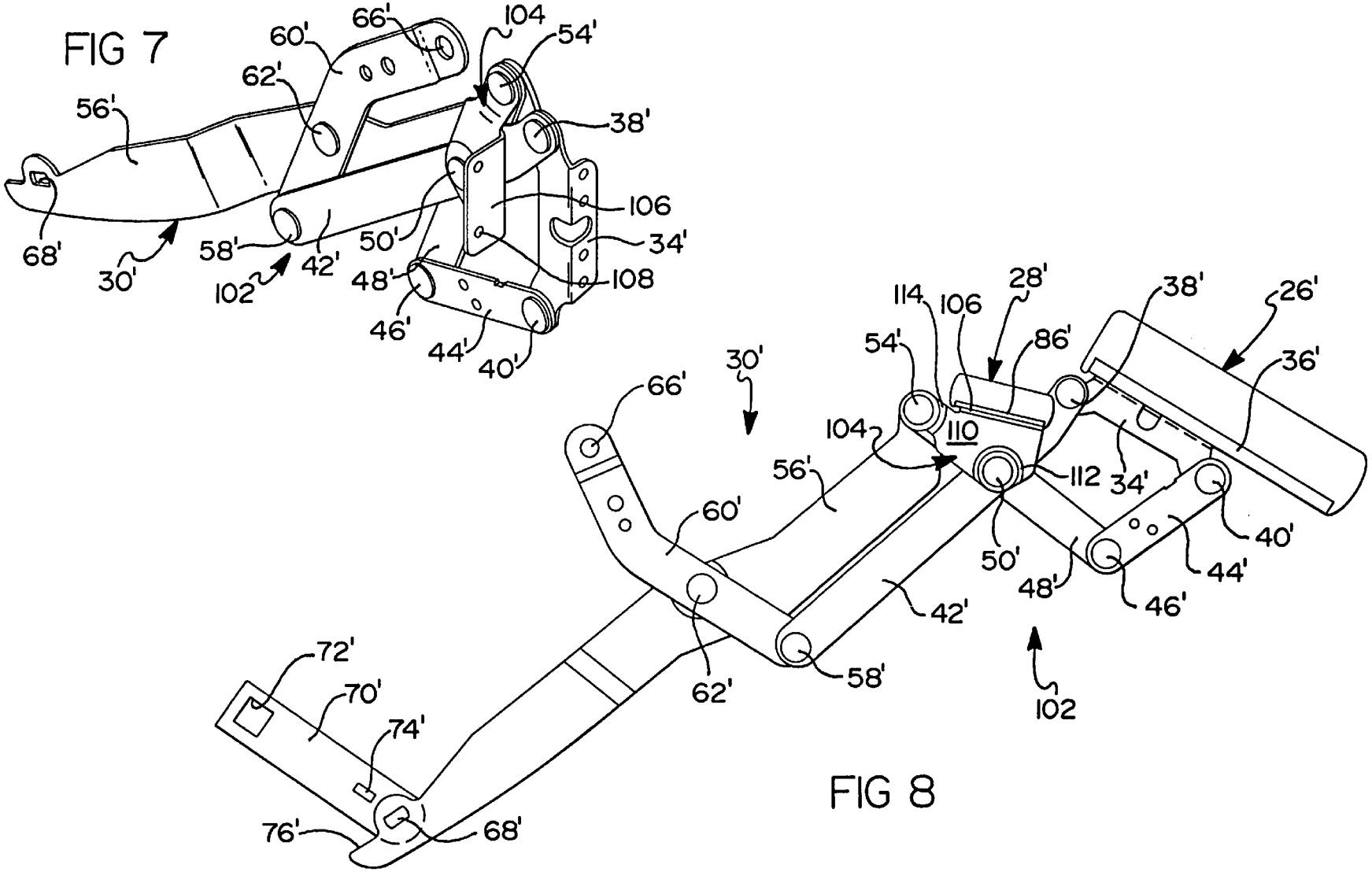
FIG. 7 is a perspective view of the linkage mechanism shown in FIG. 6.
FIG. 8 is a view of the linkage mechanism shown in FIGS. 6 and 7 in a partially extended condition.

As clearly seen from sequential review of FIGS. 6, 8, and 9, rotation of drive rod 23' causes primary linkage assembly 30' to drive primary leg rest panel 26' between a generally vertically orient alignment (stowed) and a generally horizontal alignment (extended). Moreover, ottoman link 104 is adapted to cause secondary leg rest panel 28' to move from a position behind and substantially parallel to primary leg rest panel 26' in the stowed position (FIG. 6) to an adjacent slightly angulated alignment relative thereto in the extended position (FIG. 9). Moreover, secondary leg rest panel 28' pivots in an arcuate path about pivot 54' and is driven through this arcuate path due to its common pivotable connection with rear board link 42' and connector link 48' at pivot 50'. Thus, due to the novel yet simplified construction of linkage mechanisms 102 of the present invention, a desired clearance is maintained between the leg rest panels such that the thickness of upholstered leg rest panels 26' and 28' can be identical, if so desired, to promote more attractive styling and enhanced leg support and comfort. As previously disclosed, a front edge of seat member 16' may be supported to move forwardly in concert with articulation of linkage mechanisms 102 so as to provide a predetermined relationship therebetween. In such an application, the recliner mechanism is adapted to work in coordination with the extensible movement of dual leg rest assembly 100. However, such a coordinated reclining/extensible arrangement is not required nor is it critical to the novelty of the present invention.

With particular reference to FIGS. 10 through 13, a second alternative embodiment is disclosed for the dual leg rest assembly of the present invention. More particularly, a modified linkage mechanism is disclosed that is operable for causing coordinated articulating movement of a primary leg rest panel and a secondary leg rest panel. The secondary leg rest panel is secured to a modified ottoman link having a selectable height feature contained within its associated mechanism. The height of the secondary leg rest panel can be selected by merely changing the set of pivot points used to connect the ottoman link to the leg rest assembly linkage. As with the embodiments disclosed with respect to FIGS. 1 through 5 and FIGS. 6 through 9, the modified linkage mechanism can be manually actuated via well known handle type actuation mechanisms or, alternatively, can be actuated in response to reclining movement of the seat assembly or via a motor drive actuation system. Since the particular form of the article of furniture does not per se comprise part of this invention, only those portions or components thereof necessary for a clearer understanding of the modified linkage mechanism will be described with any specificity. As such, those components shown in FIGS. 10 through 13 that are identical or substantially similar in structure and/or function to those previously described in FIGS. 3 through 9, will hereinafter be identified with similar reference numerals with a 200 series prefix.

With continued reference to FIGS. 10 through 13, the functional and structural aspects of the components associated with dual leg rest assembly 200 will be described with greater specificity. In general, dual leg rest assembly 200 can be substituted for dual leg rest assembly 20 within chair 210. In operation, dual leg rest assembly 200 can be moved between a "stowed" position and a fully "extended" position in response to manual actuation of a suitable actuation mechanism, such as by rotation of a handle 22. As previously described, angular rotation of handle 22 is adapted to cause an actuation mechanism, such as drive rod 223, to urge a pair of linkage mechanisms 202 to move synchronously between retracted and protracted positions for causing the concurrent articulated movement of a primary leg rest panel 226 and a secondary leg rest panel 228 between a stowed and extended positions, respectively. In the stowed position, secondary leg rest panel 228 is maintained in a position behind and generally parallel to primary leg rest panel 226 so as to be concealed from view. However, when handle 22 is rotated to synchronously drive linkage mechanisms 202 toward their protracted state, secondary leg rest panel 228 is pivoted along an arcuate path to establish a generally continuous and uninterrupted leg support surface between a front edge of seat cushion 216 and a rear edge of primary leg rest panel 226. As will be appreciated, while only one linkage mechanism 202 is shown, a substantially identical linkage mechanism is provided on the opposite lateral side of chair 210. Accordingly, each linkage mechanism 202 includes a primary linkage assembly 230 for causing extensible movement of primary leg rest panel 226. Each linkage mechanism 202 also includes a secondary linkage assembly 232 formed by an ottoman link 204 and ottoman control link 290 for causing concurrent and coordinated movement of second leg rest panel 228. As will be detailed, ottoman link 204 is operatively supported from primary linkage assembly 230 at pivot 294 for articulative movement in response to movement of connector link 248.

While the drawings reflect minor structural changes to the individual links of primary linkage assembly 230, it will be appreciated by those skilled in the art that the components and the pivotable scissor-type extensible (i.e., pantographic) action generated thereby is substantially identical to that previously disclosed for primary linkage 30 of linkage mechanism 24. More particularly, primary linkage assembly 230 includes an angled bracket 234 secured via suitable fasteners to one lateral edge of a rigid frame board 236 associated with primary leg rest panel 226. As such, frame board 236 is pivotably connected at a rear pivot 238 to one end of a universal rear board link 242. In addition, frame board 236 is pivotably connected at a front pivot 240 to one end of a shorter front board link 244. The opposite end of front board link 244 is pivotably connected at pivot 246 to one end of a connector link 248. The opposite end of connector link 248 is pivotably connected at pivot 254 to the top end of a long support link 256. Moreover, connector link 248 is pivotably connected at pivot 250 to an intermediate segment of universal rear board link 242. Similarly, the opposite end of rear board link 242 is pivotably connected at pivot 258 to one end of a curved swing link 260 which, in turn, is pivotably connected at a central pivot 262 to an intermediate segment of long support link 256. The opposite end of curved swing link 260 is journally supported from a front support shaft 264 for rotation about a pivot 266. In the embodiment shown, support shaft 264 is non-rotatably fixed to opposite side frame portions of chair frame 212 to act as a rigid upper cross-rail member.

Figure 14:
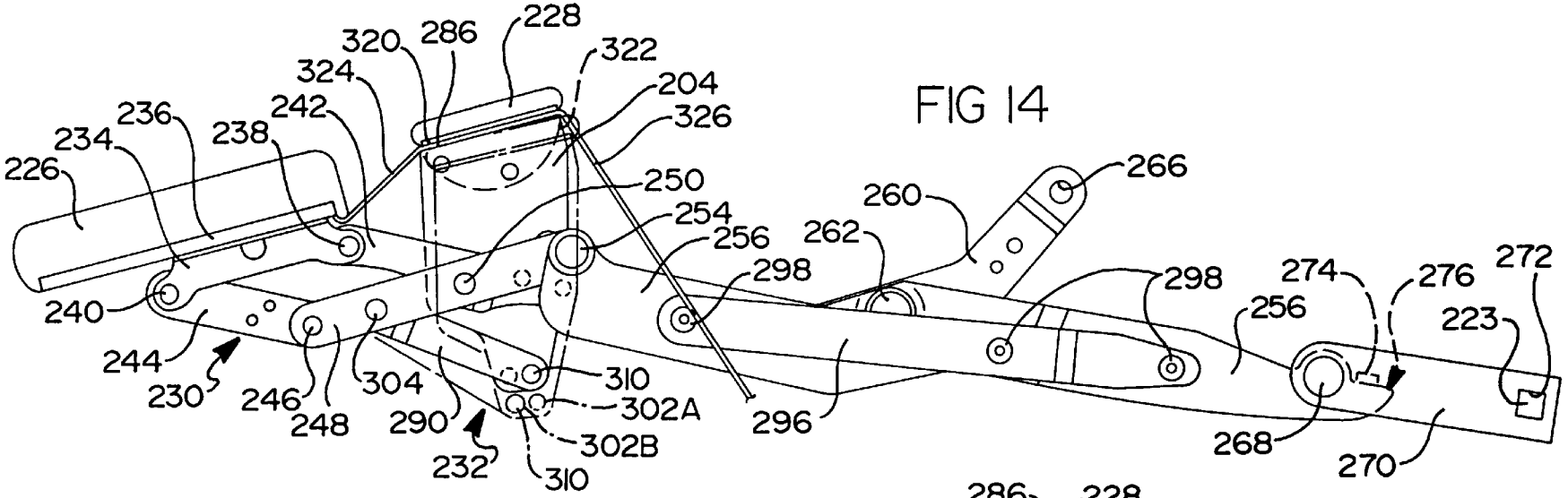
FIG. 14 is the opposite side view of the linkage mechanism and illustrates the reinforcing link attached to the long support link in accordance with a preferred embodiment of the present invention.

As best illustrated in FIG. 14, support link 256 is provided with a reinforcing link 296 secured along the outboard side of each support link 256 at three locations with suitable fasteners 298. Reinforcing link 296 provides additional reinforcing strength and prevents structural failure of support link 256 when excessive loads are placed upon leg rest assembly 200. For example, when leg rest assembly 200 is used in conjunction with health care style furniture, chair frame 212 can support the weight of an occupant while leg rest assembly 200 can support, in addition to the weight of the occupant's legs, the extra weight of an individual, such as a physician, who may inadvertently temporarily sit upon or lean downwardly against the leg rest panels 226 and 228.

Figure 13:
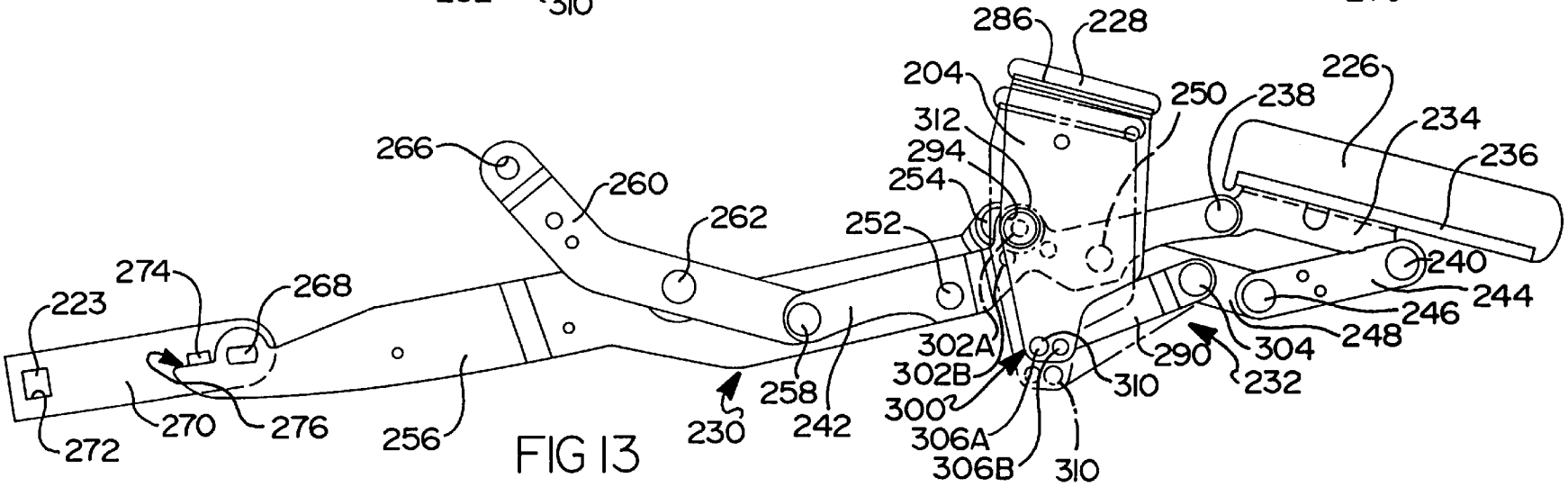
FIG. 13 illustrates the linkage mechanism shown in FIGS. 10 through 12 in a fully extended position.

A curved bottom end of support link 256 is pivotably connected at pivot 268 to one end of a drive link 270, the other end of which has a square hole 272 through which square drive rod 223 extends. As such, angular movement of drive rod 223 causes concurrent angular movement of drive link 270 and visa versa. In a manner similar to that previously described, selective rotation of drive rod 223 via handle 22 causes drive link 270 to rotate which, in turn, acts through pivot 268 to move long support link 256. Such action causes curved link 260 to swing about fixed pivot 266 so as to move rear board link 242 outwardly and upwardly. Concurrently, pivot 254 at the top end of long support link 256 causes connector link 248 to swing about central pivot 250 such that front board link 244 is also moved outwardly and upwardly. As best illustrated in FIGS. 13 and 14, once primary linkage assembly 230 is in the fully "extended" or protracted position, drive rod 223, pivot 268 and pivot 262, and hence drive link 270 and long support link 256, are approximately in-line with respect to one and another. Due to the overall configuration of primary linkage assembly 230, the alignment of various links, including drive link 270 and long support link 256, creates a self-locking condition. Accordingly, primary linkage assembly 230 can readily support the varying weight of different occupants' legs placed on frame board 236 without adversely affecting the operation of dual leg rest assembly 200. Furthermore, the alignment of drive link 270 and long support link 256, in conjunction with stop tab 274, prevents undesired retraction if an additional load is inadvertently placed on frame board 236, such as by a second individual, when dual leg rest assembly 200 is in the fully "extended" or protracted position.

As will be appreciated, such extensible action of primary linkage assembly 230 takes place simultaneously with both the left and right linkage mechanisms 202 when there is sufficient angular rotation of drive rod 223. As such, frame board 236 and primary leg panel 226 are movable between their "stowed" vertical position and "extended" protracted position.

In addition to the above structure, each linkage mechanism 202 includes a selectable height ottoman link 204 which is supported from and interactively associated with primary linkage assembly 230 to cause articulated movement of secondary leg rest panel 228 in response to articulated movement of primary leg rest panel 226. In particular, ottoman link 204 has an angled bracket segment 206 that is provided with bores 208 sized for receipt of suitable threaded fasteners for securing thereto a lateral edge of a rigid frame board 286 associated with secondary leg rest panel 228. As best seen from FIG. 11, bracket segment 206 is inwardly directed such that the length of frame board 286 can be less than that of frame board 236. This arrangement is preferable when primary leg rest panel 226 is equipped with the extensible leg rest feature disclosed in commonly owned U.S. Pat. No. 5,088,789 entitled "Retro-Fittable Extendable Legrest Apparatus".

Figure 12:
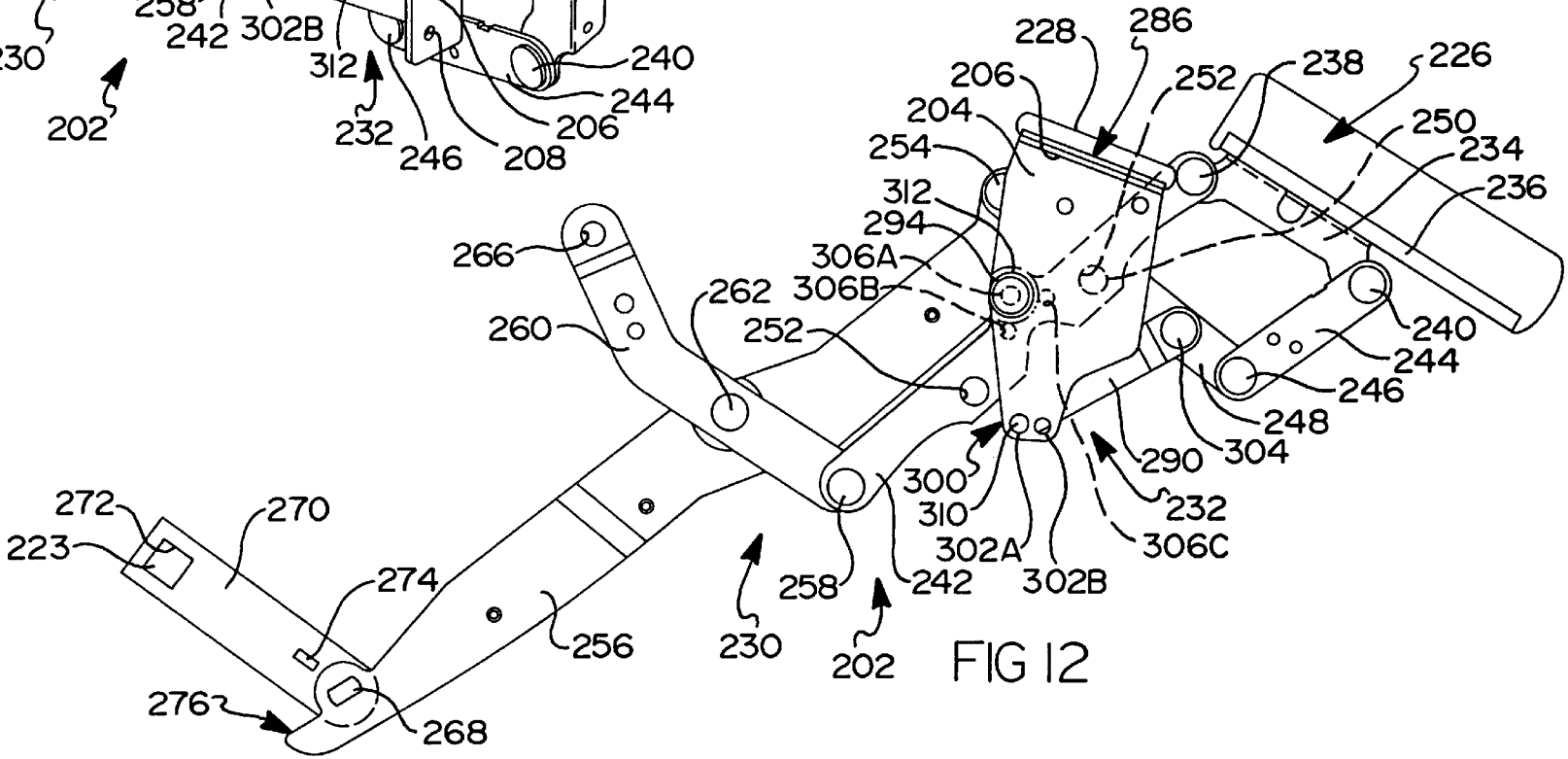
FIG. 12 is a view of the linkage mechanism shown in FIGS. 10 and 11 in a partially extended condition.

Referring to FIG. 12, the components forming secondary linkage assembly 232 are described in more detail. Secondary linkage assembly 232 includes ottoman link 204 having an embossed portion 312 about which ottoman link 204 is pivotably connected via pivot 294 to a central portion of universal rear board link 242. The lower lobe 300 of ottoman link 204 includes a pair of height selection apertures 302-A and 302-B formed therein. These apertures define alternate locations for pivot 310 at which the rear end of ottoman control link 290 is secured. The forward end of ottoman control link 290 attaches to connector link 248 at pivot 304. With continued reference to FIG. 12, universal rear board link 242 is shown in phantom. As will be appreciated by one skilled in the art, rear board link 242 is symmetrical, and thus one link 242 can be used on both the left and right side linkage mechanisms 202. The central portion of universal rear board link 242 includes three height selection apertures 306-A, 306-B and 306-C formed therein. The height of ottoman link 204 can thus be alternated between a raised position and a lowered position by selecting the pivot locations formed by the appropriate apertures. Placing ottoman link 204 in its raised position is achieved by selecting the combination of apertures 302-A and 306-A as the locations for pivots 294 and 310 respectively. Alternatively, placing ottoman link 204 in its lowered position is achieved by selecting the combination of apertures 302-B and 306-B as the locations for pivots 294 and 310 respectively. As most clearly seen in FIGS. 13 and 14, ottoman link 204 is positioned in its raised position as drawn in solid lines, and ottoman link 204 is positioned in its lowered position as drawn in phantom. As is also apparent from this description and the associated drawings, aperture 306-C becomes aperture 306-A when universal rear board link 242 is used on the opposing leg rest linkage mechanism 202. Universal rear board link 242 also includes a pair of symmetrically opposed apertures 252, one of which accommodates pivot 250 where rear board link 242 is pivotably attached to connector link 248. Thus the combination of ottoman link 204 and universal rear board link 242 provide a selectable height feature for secondary leg rest panel 228 while reducing to total number of links required to assemble dual leg rest assembly 200.

Figure 10:
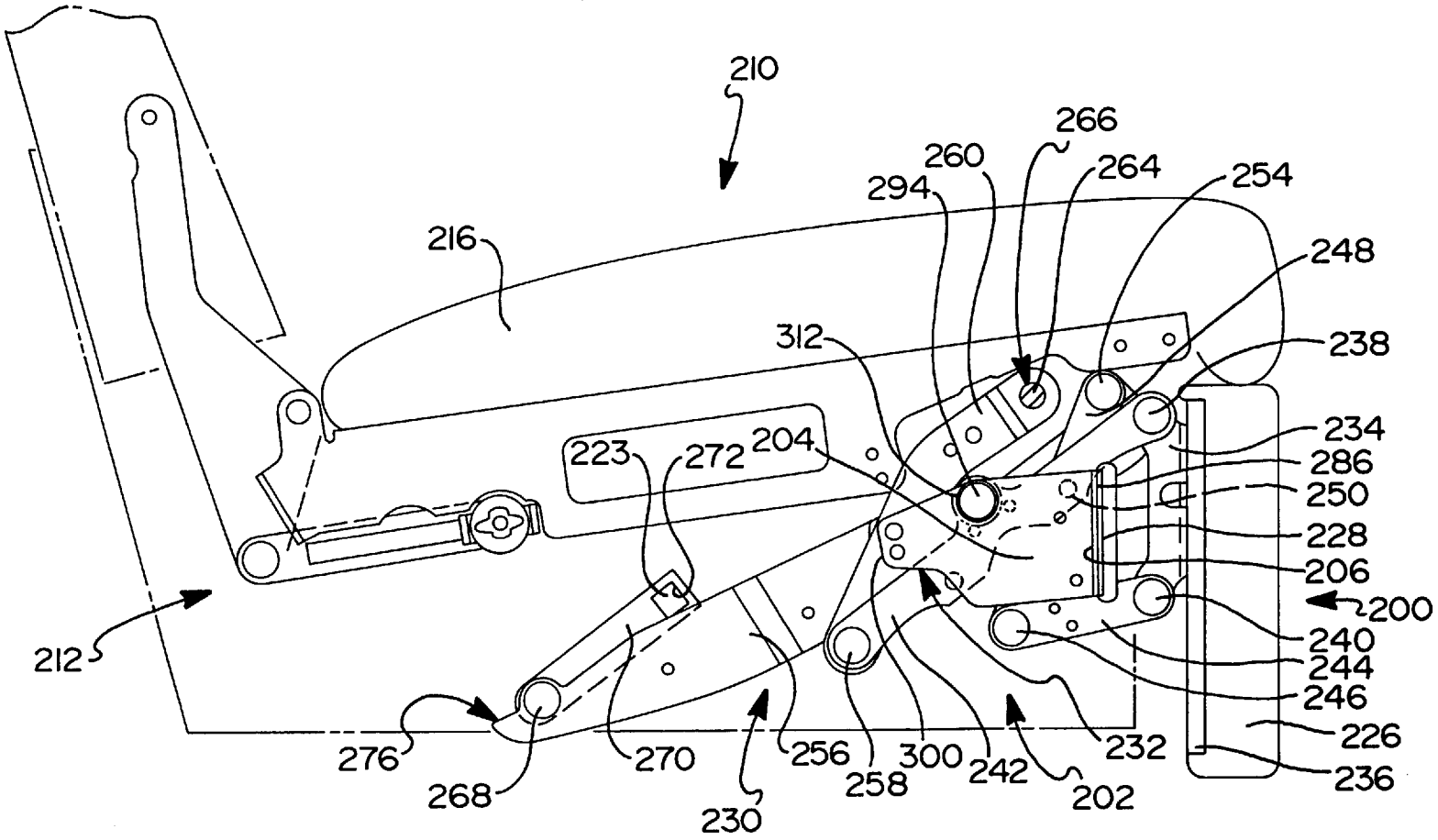
FIG. 10 is a fragmentary elevational view of a reclining chair, generally similar to the reclining chair shown in FIGS. 3 and 6, illustrating an alternative embodiment of the linkage mechanism for the dual leg rest assembly of the present invention in its fully retracted position.
Figure 11:
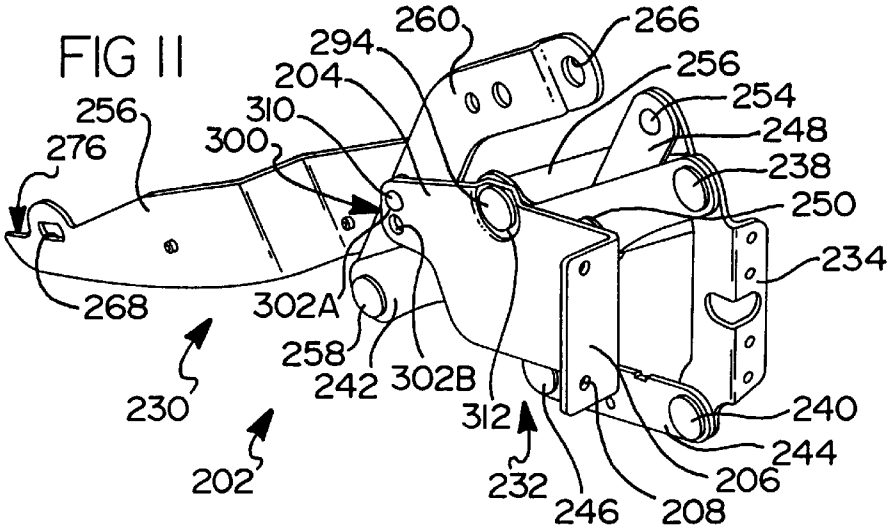
FIG. 11 is a perspective view of the linkage mechanism shown in FIG. 10.

As clearly seen from sequential review of FIGS. 10, 12, and 13, rotation of drive rod 223 causes primary linkage assembly 230 to drive primary leg rest panel 226 between a generally vertically orient alignment (stowed) and a generally horizontal alignment (extended). Moreover, ottoman link 204 is adapted to cause secondary leg rest panel 228 to move from a position behind and substantially parallel to primary leg rest panel 226 in the stowed position (FIG. 10) to an adjacent slightly angulated alignment relative thereto in the extended position (FIGS. 13 and 14). Moreover, secondary leg rest panel 228 pivots in an arcuate path about pivot 294 and is driven through this arcuate path. Thus, due to the novel yet simplified construction of linkage mechanisms 202 of the present invention, a desired clearance is maintained between the leg rest panels such that the thickness of upholstered leg rest panels 226 and 228 can be identical, if so desired, to promote more attractive styling and enhanced leg support and comfort. As previously disclosed, a front edge of seat member 216 may be supported to move forwardly in concert with articulation of linkage mechanisms 202 so as to provide a predetermined relationship therebetween. In such an application, the recliner mechanism is adapted to work in coordination with the extensible movement of dual leg rest assembly 200. However, such a coordinated reclining/extensible arrangement is not required nor is it critical to the novelty of the present invention.

As most clearly seen in FIG. 14, ottoman link 204 optionally includes an upholstered panel 320 which can be secured between secondary leg rest panel 228 and rigid frame board 286. Upholstered panel 320 is intended to fill a forward gap created between the secondary leg rest panel 228 and the primary leg rest panel 226, as well as the gap created between secondary leg rest panel 228 and seat cushion 216. Upholstered panel 320 is further defined by left and right side covers 322, forward flap 324 and rear flap 326. Left and right side covers 322 are intended to conceal the side portions of ottoman link 204. Forward flap 324 extends forwardly and downwardly to a point just below the rear portion of rigid frame board 236. Rear flap 326, which preferably comprises upholstery material without any stiffener, extends rearwardly and downwardly and attaches to front skirt panel 328.

The foregoing discussion discloses and describes exemplary embodiment of the present invention. One skilled in the art will readily recognize from such discussion, and from the accompanying drawings and claims, that various changes, modifications and variations can be made therein without departing from the true spirit and fair scope of the invention as defined in the following claims.

What is claimed is:

1. In an article of furniture having a seat assembly supported from a chair frame and an actuation mechanism for enabling a leg rest assembly to move between a stowed position and an extended position, said leg rest assembly comprising:

a primary leg rest panel;

a secondary leg rest panel; and linkage means interconnecting said primary and secondary leg rest panels to the actuation mechanism for coordinated articulated movement such that in said stowed position said secondary leg rest panel is oriented behind and in general parallelism with said primary leg rest panel so as to be concealed thereby, and in said extended position said primary and secondary leg panels are oriented so as to provide a substantial continuous and uninterrupted support surface with said seat assembly, said linkage means including a first linkage for causing articulated movement of said primary leg rest panel and a second linkage for causing articulated movement of said secondary leg rest panel, and wherein said second linkage is supported on said first linkage for movement in response to movement of said first linkage;

said first linkage comprising first and second board links pivotally connected to said primary leg rest panel, a first connector link pivotally interconnecting said first board link to said chair frame, a second connector link pivotally interconnecting said second board link to a first end of a support link, and a drive link interconnecting the actuation mechanism to a second end of said support link, said first connector link being pivotably interconnected to an intermediate portion of said support link and said second connector link being pivotally interconnected to an intermediate portion of said first board link;

said second linkage comprising a third board link having a first portion on which said secondary leg rest panel is secured, a second portion pivotally interconnected to said first board link and a third portion pivotably interconnected to a third connector link, said third board link including height selection means;

said first board link having height selection means for pivotally securing said third board link; and said third connector link pivotally coupled to said second connector link at a first end and pivotally secured to said height selection means of said third board link at a second end.

2. The article of claim 1, wherein said height selection means associated with said first board link and said third board link allows said third board link to be selectively placed in one of a lower position and an upper position, thereby adjusting a vertical displacement of said third board link.

3. The article of claim 2, wherein said height selection means comprises:

an upper aperture and a lower aperture formed in an intermediate portion of said first board link;

an upper aperture and a lower aperture formed in a lower portion of said third board link; and whereby said third board link is placed in said lower position when said third board link is secured to said lower aperture of said first board link, and said third connector link is secured to said lower aperture of said third board link; and said third board link is placed in said upper position when said third board link is secured to said upper aperture of said first board link and said third connector link is secured to said upper aperture of said third board link.

4. The article of claim 1, wherein said height selection means of said first board link comprises one of a plurality of apertures formed in an intermediate portion thereof for pivotally securing said second portion of said third board link.

5. The article of claim 1, wherein said height selection means of said third board link comprises one of a plurality of apertures formed in said third portion for pivotally securing said third connector link.

6. The article of claim 1, further comprising a cover secured to said secondary leg rest panel.

7. The article of claim 6, wherein said cover includes a first fabric panel secured between said seat assembly and said secondary leg rest panel, and a second fabric panel secured between said primary leg rest panel and said secondary leg rest panel.

8. The article of claim 6, wherein said cover includes a pair of rigid upholstered covers secured to opposite side portions of said secondary leg rest panel.

9. The article of claim 6, wherein said cover includes a first fabric panel secured between said seat assembly and said secondary leg rest panel, a second fabric panel secured between said primary leg rest panel and said secondary leg rest panel, and a pair of rigid upholstered covers secured to opposite side portions of said secondary leg rest panel.

10. The article of claim 1, wherein said first board link is symmetrical, and includes an offset formed in a central portion thereof, said central portion having an upper aperture and a lower aperture formed therein.

11. The article of claim 1, wherein said first board link is symmetrical, and further includes three apertures formed in a central portion thereof, said apertures arranged in a triangular pattern wherein a central aperture is positioned above a pair of lower apertures.

12. The article of claim 1, wherein said first board link can be universally disposed in one of a left side and a right side of said leg rest assembly.

13. In an article of furniture having a seat assembly supported from a chair frame and an actuation mechanism for enabling a leg rest assembly to move between a stowed position and an extended position, said leg rest assembly comprising:

a primary leg rest panel;

a secondary leg rest panel; and linkage means interconnecting said primary and secondary leg rest panels to the actuation mechanism for coordinated articulated movement such that in said stowed position said secondary leg rest panel is oriented behind and in general parallelism with said primary leg rest panel so as to be concealed thereby, and in said extended position said primary and secondary leg panels are oriented so as to provide a substantial continuous and uninterrupted support surface with said seat assembly, said linkage means including a first linkage for causing articulated movement of said primary leg rest panel and a second linkage for causing articulated movement of said secondary leg rest panel, and wherein said second linkage is supported on said first linkage for movement in response to movement of said first linkage;

said first linkage comprising first and second board links pivotally connected to said primary leg rest panel, a first connector link pivotally interconnecting said first board link to said chair frame, a second connector link pivotally interconnecting said second board link to a first end of a support link, and a drive link interconnecting the actuation mechanism to a second end of said support link, said first connector link being pivotably interconnected to an intermediate portion of said support link and said second connector link being pivotally interconnected to an intermediate portion of said first board link;

said second linkage comprising a third board link having a top flange to which said secondary leg rest panel is secured, an intermediate portion pivotably secured to said first board link, and a lower lobe having an upper aperture and a lower aperture formed therein, one of said upper and lower apertures pivotably secured to a third connector link;

said first board link having an upper aperture and a lower aperture formed therein, one of said upper and lower apertures for pivotably securing said third board link;

said third connector link pivotally coupled to said second connector link at a first end and pivotally secured to one of said upper and lower apertures of said third board link at a second end; and a cover secured to said secondary leg rest panel.

14. The article of claim 13, wherein said upper and lower apertures formed in said first board link, and said upper and lower apertures formed in said third board link allow said third board link to be selectively placed in one of an upper position and a lower position, thereby adjusting a vertical displacement of said third board link.

15. The article of claim 13, wherein said third board link is placed in a lower position when said third board link is secured to said lower aperture of said first board link, and said third connector link is secured to said lower aperture of said third board link; and said third board link is placed in an upper position when said third board link is secured to said upper aperture of said first board link and said third connector link is secured to said upper aperture of said third board link.

16. The article of claim 13, wherein said cover includes a first fabric panel secured between said seat assembly and said secondary leg rest panel, and a second fabric panel secured between said primary leg rest panel and said secondary leg rest panel.

17. The article of claim 13, wherein said cover includes a pair of rigid upholstered covers secured to opposite side portions of said secondary leg rest panel.

18. The article of claim 13, wherein said cover includes a first fabric panel secured between said seat assembly and said secondary leg rest panel, a second fabric panel secured between said primary leg rest panel and said secondary leg rest panel, and a pair of rigid upholstered covers secured to opposite side portions of said secondary leg rest panel.

19. The article of claim 13, wherein said first board link is symmetrical, and further includes three apertures formed in a central portion thereof, said apertures arranged in a triangular pattern wherein a central aperture is positioned above a pair of lower apertures.

20. The article of claim 13, wherein said first board link can be universally disposed in one of a left side and a right side of said leg rest assembly.

* * * * *